US009822624B2

(12) United States Patent
Wang et al.

(10) Patent No.: US 9,822,624 B2
(45) Date of Patent: Nov. 21, 2017

(54) VAPOR BLOW THROUGH AVOIDANCE IN OIL PRODUCTION

(71) Applicants: ConocoPhillips Company, Houston, TX (US); Total E&P Canada Ltd., Calgary (CA)

(72) Inventors: Jianshe Wang, Houston, TX (US); Danial Kaviani, Houston, TX (US); David A Brown, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 284 days.

(21) Appl. No.: 14/625,115

(22) Filed: Feb. 18, 2015

(65) Prior Publication Data

US 2015/0260027 A1 Sep. 17, 2015

Related U.S. Application Data

(60) Provisional application No. 61/953,983, filed on Mar. 17, 2014.

(51) Int. Cl.

| | |
|---|---|
| ***E21B 43/24*** | (2006.01) |
| *E21B 47/04* | (2012.01) |
| *E21B 43/12* | (2006.01) |

(52) U.S. Cl.

CPC ..... *E21B 43/2408* (2013.01); *E21B 43/126* (2013.01); *E21B 47/04* (2013.01)

(58) Field of Classification Search

CPC ..... E21B 43/21; E21B 43/122; E21B 43/126; E21B 43/128; E21B 43/2408

See application file for complete search history.

(56) References Cited

U.S. PATENT DOCUMENTS

| | | | | |
|---|---|---|---|---|
| 5,016,712 | A | 5/1991 | Cullick | |
| 5,555,934 | A | 9/1996 | Haufler | |
| 6,457,950 | B1 | 10/2002 | Cooper | |
| 6,484,740 | B2 | 11/2002 | Guthrie | |
| 2004/0060707 | A1 | 4/2004 | Bearden | |
| 2004/0064292 | A1* | 4/2004 | Beck | E21B 43/126 702/182 |
| 2008/0060846 | A1* | 3/2008 | Belcher | E21B 17/042 175/25 |
| 2013/0037260 | A1* | 2/2013 | Reed | E21B 43/126 166/244.1 |
| 2014/0262238 | A1* | 9/2014 | McCrickard | E21B 43/12 166/250.01 |

FOREIGN PATENT DOCUMENTS

WO 2012015416 11/2012

OTHER PUBLICATIONS

International Search Report for PCT/US2015/016338, dated May 22, 2015.

* cited by examiner

*Primary Examiner* — Brad Harcourt

(74) *Attorney, Agent, or Firm* — ConocoPhillips Company

(57) ABSTRACT

A vapor blow through avoidance method, process and system for oil producing wells developed based on an innovative theory of vapor blow through pump. The system consists of casing gas remover, dynamic fluid level detector and downhole pump. Process includes adjusting casing gas remover and or pump rate based on result of comparison of the detected dynamic fluid level with the pre-set target dynamic fluid level; therefore, it prevents vapor in annular space blowing through pump and optimizes the well production. The avoidance system applies to single or group and horizontal or vertical wells.

18 Claims, 5 Drawing Sheets

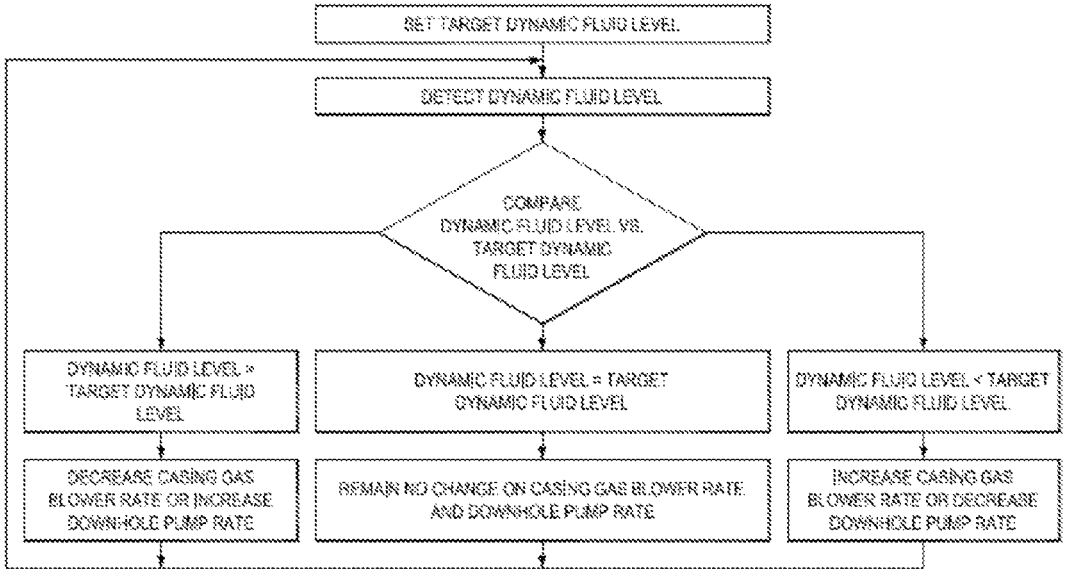
FIG. 3
FIG. 4
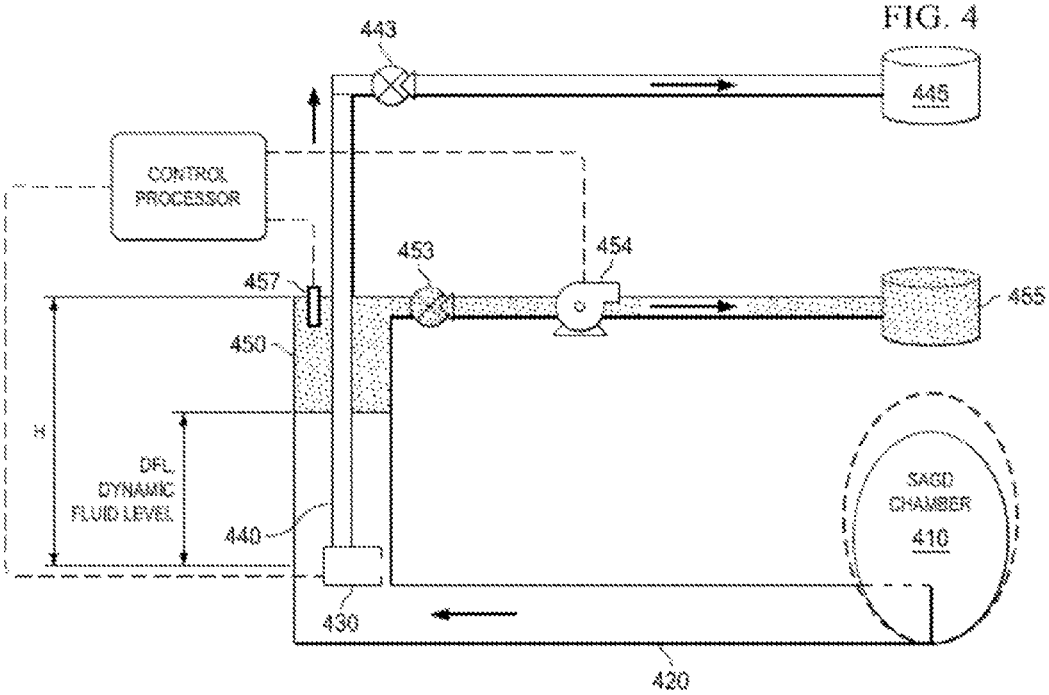

VAPOR BLOW THROUGH AVOIDANCE IN OIL PRODUCTION

PRIOR RELATED APPLICATIONS

This application claims priority to U.S. Ser. No. 61/953,983, Mar. 17, 2014, and incorporated by reference herein in its entirety for all purposes.

FEDERALLY SPONSORED RESEARCH STATEMENT

Not applicable.

FIELD OF THE DISCLOSURE

The disclosure generally relates to methods, devices, systems and software for avoiding the vapor blow through of downhole pumps used for artificial lift in oil production.

BACKGROUND OF THE DISCLOSURE

Early in the productive lifespan of an oil well, the reservoir is under sufficient pressure to bring the oil to the surface. However, as oil is depleted, at some point the pressure will not suffice to bring oil to the surface and at this point, the natural lift mechanisms must be augmented. Frequently, a downhole pump, for instance an electric submersible pump (ESP), is placed downhole and used to provide artificial lift. However, such pumps are usually designed to pump fluids, with limited vapors, and do not function effectively when vapor enters the pump.

Low-pressure areas are created in the ESP pump stage vanes as they rotate. Gas can build up in this region and reduce the pump efficiency, or even block the passage of the entire vane or multiple vanes in the pump, which may lead to the need to shut down and restart the system, and/or to premature or catastrophic pump failure. This is called "gas-lock" in the industry. However, it is common that "gas-locking" is loosely used by the industry to refer to any and all pump problems triggered by vapors.

It was originally believed that gas-locking or vapor interference would not present significant problems in SAGD operations because the original hydrocarbon gas saturation is very low in these bitumen oil fields. However, the problem of vapor-interference is increasingly becoming recognized as an impediment in SAGD operations, where vapor can enter the system from a number of different sources, some of which are not understood and may not be monitored.

In SAGD, well pairs are typically vertically displaced 4-5 meters from one another, the upper well being used for steam injection to mobilize the heavy oil which then drains to the lower well for production. Although a subcool is maintained at about 7-10° C. in order to ensure that steam does not breakthrough to the producer well, vapor breakthrough can happen, leading to vapor entering the downhole pump.

Hydrocarbon gas from reservoir fluid may break out from solution and become a free gas when it enters into wellbore due to lower pressures there. Additionally, if oil reservoir pressure is lower than saturation pressure, some free gas may exist in reservoir and could flow into wellbore together with reservoir fluid. In the case of hot steam flooding, hot water that enters into wellbore can flash into steam vapor due to lower pressure. Another source of vapor comes from aquathermolysis, which is the reaction involving hot water or steam and reservoir mineral clays and crude hydrocarbon and generates gases like $CO_2$ and $H_2S$. It is important to understand that the volume of these vapors is proportional to the amount of liquid flowing into wellbore and being produced.

Up to now, attempts to address the gas-locking problem have been directed at modifying the downhole pump alone to either minimize gas entry and/or to shuttle it safely aside at some point. Work is also underway to develop multiphase downhole pumps that can pump both liquids and gases. However, none of those efforts solve the problem for existing downhole pumping systems especially for hot SAGD producers.

Some SAGD producers have experienced No Flow or Low Flow (NF/LF), event, sometimes referred as "deadhead". When NF/LF happens, liquid production gets lost or goes very low. ESPs run with lower amperage but frequency remains constant. As a consequence, NF/LF events cause production down time and become an optimization constraint. A temporary measure to deal with the NF/LF is to quickly drop and resume the pump hertz and although capble of bringing the well back to production, the well cannot be optimized to its productivity potential after such an event.

Thus, there remains a need in the art to solve the vapor interference problem, particularly as relates to SAGD and other steam based heavy oil production methods, and particularly to NF/LF events.

SUMMARY OF THE DISCLOSURE

This disclosure for the first time reveals a new concept of a "vapor blow through avoidance" system. When "vapor blow through" happens, the fluid column inside tubing is replaced by vapor, which results in the pump idling (e.g., not lifting any liquid) and inefficiencies in production. This is different from gas-locking, which is an issue inside the pump, and has heretofor not been recognized as the cause of periodic slow downs in production.

The primary cause of the vapor blow through is the accumulation of too much vapor in the casing annular space. If the vapor is not removed as quickly as gas enters the annular space, it will build up, thus pushing the fluid level lower. Eventually, the fluid will push down to "0" (e.g., the pump intake) and the gas will enter the pump and stop or slow the fluid flow for a period of time. This releases the vapor pressure, and the system will again commence flow of fluid.

Although vapor blow through may only last minutes, the recovery or resumption to production takes much longer due to the time required to rebuild the dynamic fluid level and includes any pump restarting time. Therefore, lost production is associated with the entire recovery time as well as the vapor blow through time.

The blow through and recharge cycle will then repeat, as influenced by the reservoir inflow rate, the vapor liquid ratio, and other well operation conditions.

The inventive methods, devices and systems were created based on this new identification of the problem of vapor blow through. The invention includes a system, devices and software that allows casing vapor to be selectively removed according to the change of the dynamic fluid level in the casing. Therefore, it avoids the vapor blow through, improves pump consistency and therefore improves oil production.

More particularly, a method of preventing vapor blow through in downhole pumps for producing oil from a reservoir is provided, the method comprising first providing the well with a vapor blow through avoidance system comprising 1) a casing gas remover (CGR), which can be a casing gas blower (CGB), adjustable choke (AC), any type of compressor or multiphase pump, or a combination thereof; 2) a dynamic fluid level detector (DFLD); 3) a downhole pump (DHP); and 4) a control processor operatively connected to said CGR, DFLD, DHP. Other sensors and detectors typically associated with production wells can be included (e.g., a pump flow rate detector), but the above parts are the minimum needed for the system to function.

The method requires continuously determining dynamic fluid level (DFL) and comparing each determined DFL against a target DFL (DFLt). The target DFL is set some safe distance above the pump intake, and can be a range of acceptable levels, thus allowing the system time to implement the corrective measures. The rates of removal of the CGR and/or DHP are thus adjusted according to the following logic:

i) increasing said CGR rate and/or reducing said DHP rate if DFL<DFLt;

ii) maintaining said CGR and said DHP rate if DFL=DFLt;

iii) decreasing said CGR rate and/or increasing said DHP rate if DFL>DFLt.

In more detail, the present disclosure includes one or more of the following embodiments, in any combination of one or more thereof.

A method of preventing vapor blow through in a production well for producing oil from a reservoir, said method comprising:

a. determining a dynamic fluid level (DFL), b. comparing said determined DFL against a target DFL (DFLt), and:

i. increasing a rate of casing gas removal or reducing a rate of pumping fluid if DFL<DFLt;

ii. maintaining said rate of casing gas removal and said rate of pumping fluid if DFL=DFLt;

iii. decreasing said rate of casing gas removal or increasing said rate pumping oil if DFL>DFLt.

A method of preventing vapor blow through in a production well, said method comprising:

a. providing a vapor blow through avoidance system for an oil well, said system comprising: i. a casing gas remover (CGR); ii. a dynamic fluid level detector (DFLD) for detecting a dynamic fluid level (DFL); iii. a downhole pump (DHP); iv. a control processor operatively connected to said CGB, DFLD and DHP;

b. said DFLD determining said DFL;

c. said control processor comparing said DFL against a target DFL (DFLt) and i. increasing a rate of said CGR or reducing a rate of said DHP if DFL<DFLt; ii. maintaining said rate of said CGR and said rate of said DHP if DFL=DFLt; iii. decreasing said rate of said CGR or increasing said rate of said DHP if DFL>DFLt.

A vapor blow through avoidance system for an oil well, said system comprising:

a. a casing gas remover (CGR) fluidly connected to a casing gas exit tube fluidly connected to an annular spacing around a production tubing, wherein said CGR is a casing gas blower (CGB) or an adjustable choke (AC) or both;

b. a downhole pump (DHP) in said production tubing and having a pump intake at or near a well bottom;

c. a dynamic fluid level detector (DFLD) for measuring a dynamic fluid level (DFL), said DFL being a height of a fluid in said annular spacing from a top of said pump intake to a gas cap in said annular spacing; and d. a control processor operatively connected to said CGR, CGB, DFLD and DHP and capable of comparing said DFL to a target DFL and adjusting said CGR or DHP to keep said DFL at said target DFL.

A method or system as herein described wherein said vapor blow through avoidance system further comprising a temperature sensor, a pressure sensor, a flow sensor, and one or more pump operating parameter sensors.

A method or system as herein described wherein said CGR is a casing gas blower (CGB) or any type of compressor or any type of multiphase pump or adjustable choke (AC) or combination of the above.

A method or system as herein described wherein said CGR includes both an AC and a CGB and wherein primary control is via said AC and secondary control is via said CGB and ternary control is via said DHP.

A method or system as herein described wherein said determining step is continuously determining said DFL, or repeatedly determining said DFL.

A method or system as herein described wherein said DFLt is a range of acceptable dynamic fluid levels, preferably at least one meter, in a more typical case ten or more meters, above zero, wherein zero is the level of intake of said DHP.

A method or system wherein the DFLD continuously determines said DFL and said control processor: a. increases a rate of said CGR or reduces a rate of said DHP if DFL<DFLt; b. maintains said rate of said CGR and said rate of said DHP if DFL=DFLt; or c. decreases said rate of said CGR or increases said rate of said DHP if DFL>DFLt.

A method or system as herein described and applied to a group of wells.

A method or system as herein described and applied to a group of wells, each well having an AC and said group of wells having a common CGB.

A method or system as herein described, said each well having a target DFL and said control processor primarily controlling each well via controlling said AC, secondarily controlling said common CGB, and ternary control of said DHP.

A computer system and/or software for preventing vapor blow through in an oil production well as herein described.

A computer system for preventing vapor blow through in an oil production well, said computer system including a processor and software, said processor accepting data from an operably connected DFLD and said software controlling an operably connected DHP and controlling an operably connected CGR, CGB or AC or both, said software increasing a rate of said CGR or reducing a rate of said DHP if DFL is ("<") lower than a target DFL, and decreasing said rate of said CGB or increases said rate of said DHP if DFL is (">") higher than said target DFL.

As used herein, the term of "vapor" means all material in vapor state, which includes wet steam, natural gases and other incondensable gases like $CO_2$ and $H_2S$.

As used herein, the phase of "vapor blow though" means vapor entering the pump and production tubing to slow or stop the production of liquid from a reservoir.

As used herein, a "CGR" is any device that allows the selective removal of casing vapor, thus reducing casing pressure. It include active systems, such as a casing gas blower or CGB, which is any blower or booster or compressor or multi-phase pump or choke device that causes casing vapor to exit the casing at a controllable rate. Gas blowers or gas boosters are well known in the industry and are commercially available from many sources. The term casing gas remover or CGR also includes passive means of allowing gas exit, such as an adjustable choke or AC. The CGR and AC are of course fluidly coupled to the casing gas flow line or other casing gas exit pathway.

The CGB for thermal or steam flooding well need to satisfy the steam temperature and multi-phase requirement since vapor could be a mixture of steam, some light end crude, hot water and incondensable gases. As example, multi-phase pumps like metal twin screw, metal gear pump, or metal PCP, could be used.

As used herein, the "dynamic fluid level" or "DFL" is the height of the liquid column in the annular spacing of a producing wellbore, measured from the top of the pump discharge to the beginning of the vapor or gas cap in the annular casing. The liquid-to-vapor interface may not be sharp, as steam break through can result in a dense, wet gas cap. As result, it is possible that no clear interface can be detected. However, a pseudo interface can be established based on fluid density gradient or pressure gradient change with depth. Further, the target DFL can be set to allow a safety zone, thus accommodating some error in measuring the exact level of the interface.

As used herein, the "DFLD" is any detector that can measure the DFL. The DFLD can be based on either direct or indirect methods, and include float (buoyancy) type mechanical sensors, or various electrical sensors, such as Density sensors, pressure or pressure gradient sensors, acoustic sensor, buoyancy, optic, capacitance, and ultrasonic point level switches, plus ultrasonic, and magnorestrictive continuous level transmitters. Combination sensors are already commercially available, e.g. Rodless Pumps™ Inc. makes a QYB BSH serial ESP downhole sensor that measures pressure, temperature and fluid level downhole. Core-Lab™ also has downhole monitoring systems, as do many other service companies.

A preferred DFLD is a fluid density gradient or density profile detector, which allows the detection of a pseudo interface. Since fluid in annular space could be in such a condition that no clear vapor and liquid interface exist due to the emulsified fluid caused by continuous boiling or steam flashing together with high interfacial tension heavy oil and the existing of natural gas. In such case, a density gradient change can provide a reasonably accurate determination of the DFL.

By "continuously," we include both continuous measurement systems (e.g., producing a line trend), and repetitive discrete measurements that occur with sufficient frequency (e.g., 1.0-60 data points per minute) so as to provide an effectively continuous measurement.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention, such as instructions for use, batteries, back-up systems, typical sensor and monitors, and the like.

The following abbreviations are used herein:

| ABBREVIATION | TERM |
|---|---|
| AC | Adjustable choke |
| bh | Bottom hole |
| CGR | Casing gas remover |
| CGB | Casing gas blower |
| DFL | Dynamic fluid level |
| DFLD | Dynamic fluid level detector |
| DFLt | Target dynamic fluid level |
| DHP | Downhole pump |
| ESP | Electric submersible pump |
| GLR | Gas Liquid Ratio |
| VLR | Vapor liquid ratio |
| LF | Low flow |
| NF/LF or LF/NF | No flow and or Low flow |
| Mx | Mole fraction of component x |
| NF | No flow |
| P | Pressure |
| Pbh | Pressure at bottom hole |
| Pe | SAGD chamber pressure |
| Pwh | Tubing pressure at well head |
| Pip | Pump intake pressure |
| Pdis | Pump discharge pressure |
| Pc | Casing presusre at well head |
| PCP | Progressive cavity pumps |
| Q | Flow rate |
| Qag | Gas flow rate for aquathermolysis gas |
| Qcg | Flow rate for connate gas and reservoir solution gas |
| Qeg | Gas flow rate for ESAGD process, also known as ES-SAGD. Enhanced SAGD, injecting solvent with steam, which result more vapor flow into producer well bore. |
| Qo | Flow rate for oil |
| Qdhg | Flow rate of vapor enter and generated in downhole wellbore Qdhg = Qsg + Qag + Qcg + Qeg |
| Qsg | Flow rate for flashing steam |
| Qcsg | Vapor flow rate of well head casing stream |
| Qwhg | Vapor flow rate of well head tubing stream |
| Qw | Flow rate water (liquid) |
| SAGD | Steam assisted gravity drainage |
| T | Temperature |
| Tbh | Temperature at bottom hole |
| Te | SAGD chamber temperature |
| Twh | Temperature at well head |
| wh | Well head |
| whg | well head gas |
| whl | well head liquid |
| ρv | Overall vapor Density ρv = ρs ms + ρa ma + ρm mm |
| ρa | Density of aquathermolysis gases (including $CO_2$ and $H_2S$) |
| ρc | Density of methane and other light hydrocarbon gases |
| ρs | Density of steam at x % |
| VBT | Vapor blow through |

BRIEF DESCRIPTION OF FIGURES

The present system is demonstrated with respect to the following figures, which are exemplary only, and should not unduly limit the scope of the appended claims.

FIG. 1D: Vapor blow through.

FIG. 1E: Fluid fill-up after vapor blow through.

FIG. 3: Processor logic for vapor blow through avoidance.

FIG. 4: Schematic of vapor blow through avoidance system—single well.

DETAILED DESCRIPTION

The present system is exemplified with respect to a SAGD well with an ESP pump. However, this is exemplary only, and the invention can be broadly applied to any high vapor producing well wherein the downhole pump has a tendency to blow through by vapor. The invention also has the advantage of reducing gas-locking, although this is not the primary intent. The following examples are intended to be illustrative only, and not unduly limit the scope of the appended claims.

The Problem

Downhole pumps in the oil industry are designed mainly for lifting liquids. They are designed on the assumption that vapor is separated downhole and directed to the casing annulus, thus not entering the pump and causing problems. Depending on the pump specifications, the presence of vapor/gas phase more or less reduces the downhole pump efficiency.

However, the amount of vapor that can be vented out from the annulus is restricted by the pressure of the casing gas treater. If the rate of the vapor accumulation is higher than the rate that expelled from the casing and tubing, e.g.:

$$Qdhg>(Qcsg+Qwhg)$$

More vapor will be accumulated in the casing annulus, and the increased volume and/or pressure can lower the level of liquid above the pump. If this level lowers to the pump intake level, vapor will enter the pump and reduce the overall pump performance, producing periods where no or low liquid is produced.

We have studied a variety of parameters during normal and no-flow or low-flow conditions in actual SAGD wells, and our results are shown in simplified manner in FIGS. 1A-E to 2 and described below.

Figure 1A:
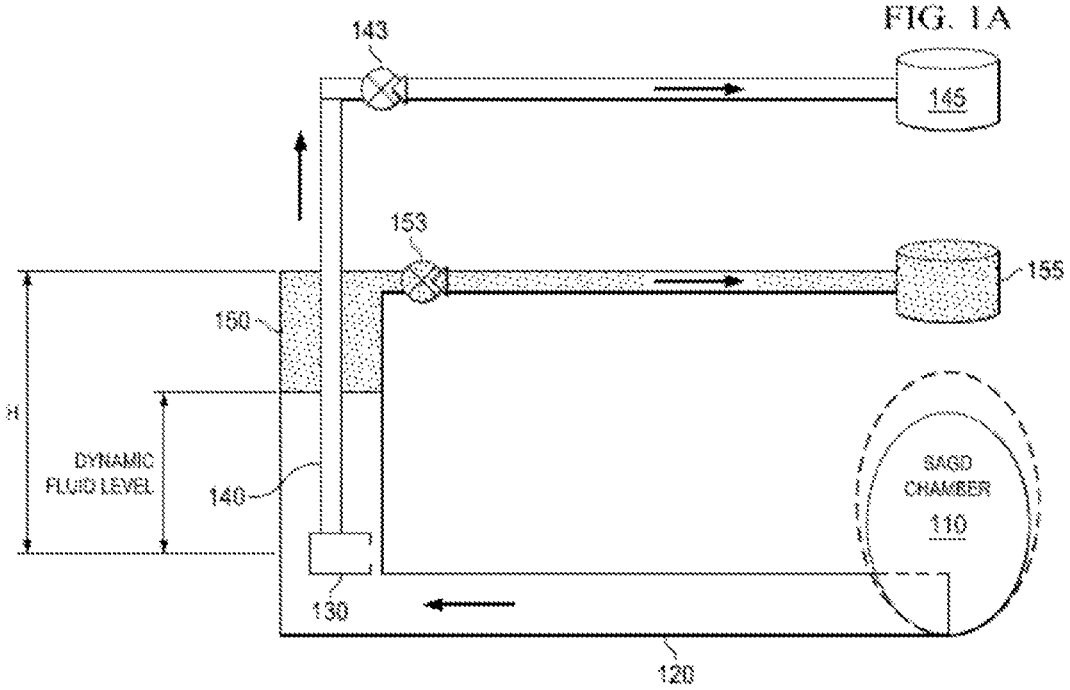
FIG. 1A: Schematic of the normal operation of a production system with a downhole pump.

FIG. 1A illustrates a typical normal flow condition, where vapor in annular is produced at a level that matches the vapor shunted out of the casing. Since gas removal occurs at levels equal to the rate of gas accumulation, the system is stable.

In more detail, FIG. 1A (not drawn to scale) shows the SAGD chamber 110 where oil gravity drains to the casing liner 120. Oil enters the downhole pump 130, but vapor typically rises and is collected in the annular casing 150, where it travels via through casing valve 153 to e.g., casing gas treater 155, and from there to various treatments and/or shipment. Oil continues to flow up via production tubing 140 to valve 143 to e.g., production separator 145 and from there to various treatments and/or shipment. In a desired and ideal operation, such as that shown here, the total vapor entering the system is equal the vapor exiting the system via the casing valve 153. The system is thus stable.

Figure 1B:
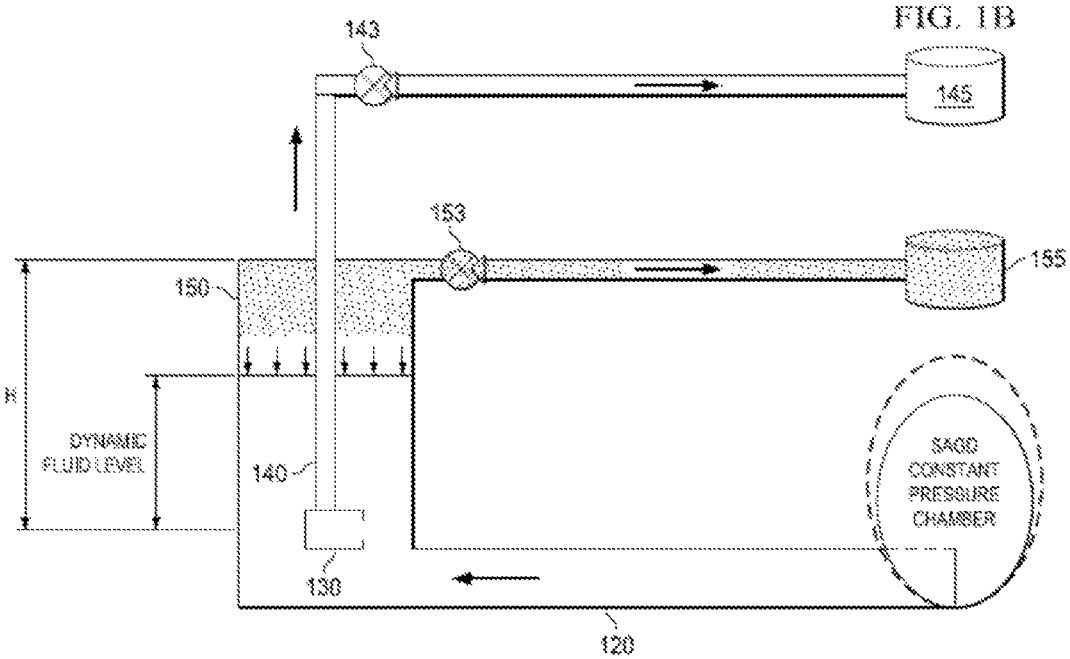
FIG. 1B: Vapor build-up in annular space.
Figure 1C:
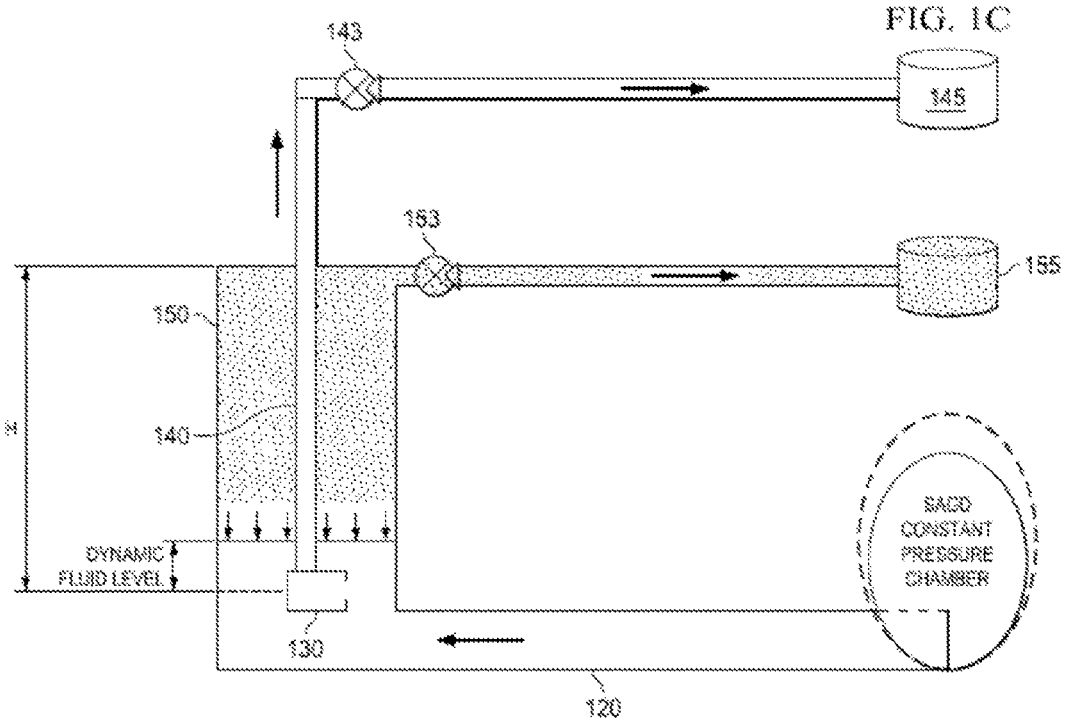
FIG. 1C: Increasing gas build-up in annular space.

However, casing vapor removal is constrained by pressure and pipe size. When vapor accumulates faster than it can be removed, this results vapor column build up, as shown in FIGS. 1B and 1C. This vapor continuously accumulates in the annular space and pushes the dynamic fluid level (DFL) down (see arrows).

Figure 1D:
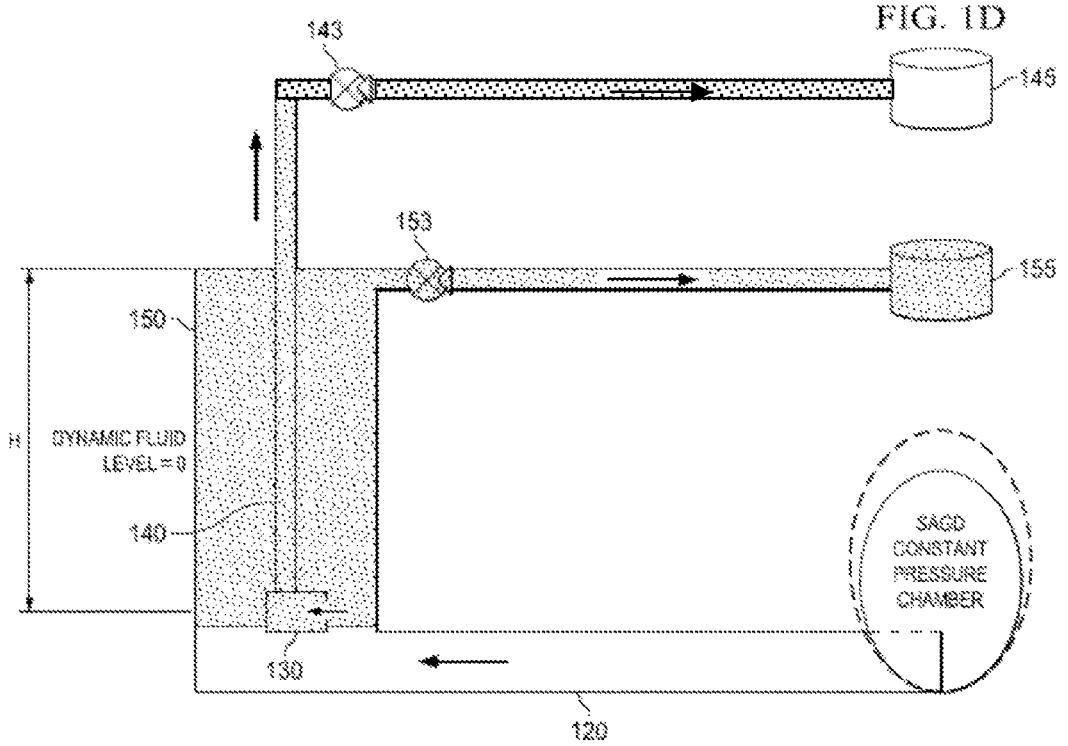
Figure 1E:
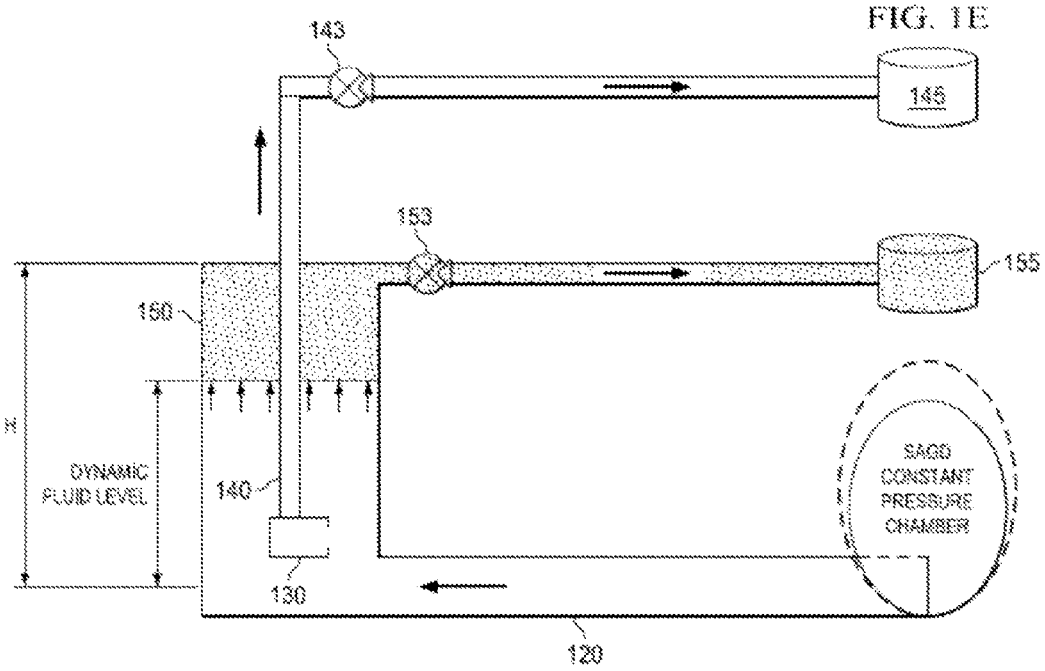

Eventually vapor builds up to a sufficient level as to cause "Gas Blow Through," as shown in FIG. 1D. In detailed explanation, when the vapor volume is large enough and the DFL is low enough (DFL=0), vapor breaks through into the pump 130 and production tubing 140. As a result, fluid density in the tubing 140 reduces due to vapor or gas emulsions in the tube and pump load reduces.

At this time, well-head pressure approaches the level of casing head pressure. Even though the downhole pump is running, it runs idle, meaning little or no liquid is being "pumped" to the surface since the tubing is filled with mostly vapor or a gassy emulsion, resulting in a NF/LF event. In the case of an ESP pump, the pump current (amperage) drops due to the low load. Some downhole temperature change due to the Joule Thompson effect may also occur, associated with gas expansion or compression.

The blow through is typically of short duration because the annular space volume is relative small, and typically the vapor accumulation rate is much lower than the blow through rate. Thus, the pressure is quickly released. After the blow through, the tubing/casing annular space refills with reservoir fluids (FIG. 1E), which makes the dynamic fluid level rise and production flow eventually recovers.

The reservoir fluid may flow into the wellbore with a velocity that may create a temporary bottom hole pressure surging. This may be explained as a result of fluid velocity momentum due to the fact that reservoir fluid is hydraulically connected to the wellbore, and is many times larger in size than the wellbore.

It is also noted that when fluid is filling up the wellbore the fluid column density increases from the prior vapor blow through condition, and that well head and/or bottom hole temperature changes may be observed due to Joule Thompson effect. The gas column build up may start again, and the cycle repeats.

Figure 2:
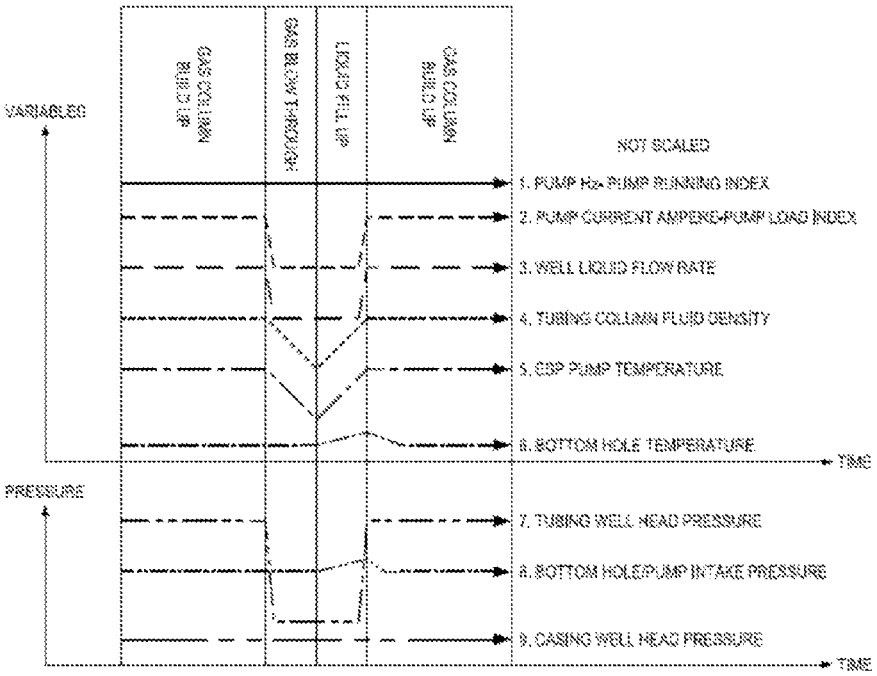
FIG. 2: Vapor blow through model indexes.

A simplified Vapor Blow Through Model Indexes are shown in FIG. 2 for an ESP pump case. As can be seen, when gas blow through occurs, the pump current drops although the pump frequency remains the same. This is because the vapor or gassy emulsion weighs less, which reduces the load on the pump, resulting in reduced current draw (amperage).

Also seen in FIG. 2, the casing well-head pressure remains the same. Bottom hole or pump intake pressure increases when tubing fluid falls down and back to the annulus. Another reason for bottom hole pressure to increase is the wellbore is recharged by reservoir fluid. Once the blow though completed, a liquid fill-up stage occurs, wherein pump temperature and bottom hole temperature rise, fluid density in the tubing recovers and bottom hole pressure and pump intake pressure increase.

This cycle could repeat at various rates, depending on the existing well conditions. For instance, cycle repeat can happen in hours for some high vapor wells, while in days or weeks for low vapor wells. It is also noted that the production rate also impacts the cycle period.

The Solution

The solution to the problem of vapor blow through is the installation of a vapor blow through avoidance system, discussed next. The system typically requires the following components:

1. A casing gas remover (CGR), which can be a any type of compressor or multiphase pump, but preferably a casing gas blower (CGB) or an adjustable choke (AC), or both. The CGR is installed at e.g., the well-head casing to reduce casing gas pressure, removing it to e.g., the casing gas treater or other unit.

2. A dynamic fluid level (DFL) detector (DFLD) is installed at the well-head or downhole (as appropriate) that can detect the DFL. Such detectors detect e.g., the interface between vapor and liquid (or a pseudo interface) numerically representing DFL. Alternatively, this DFL can be calculated based on the bottom hole pressure if fluid density can be well defined. Other ways to calculate DFL include detecting fluid density profile by series of density sensor or pressure sensors. Buoyancy, sound wave detector, optic, temperature or acoustic, resistance or capacitance and other methods could be used as well. Either gradient, absolute value or their profile can be used to detect the DFL.

3. A downhole pump, which could be any pump used for lifting the fluid. It is noted that since ESP is used as example in this disclosure, amperage is the pump load indicator. As a skilled person knows for other types of pump, pump load is indicated as: rod pump by its load cell on rod, PCP (progress cavity pump) by rod torque and hydraulic pumps by their power fluid pressure.

4. A control processor that collects the related data, performs the analysis, and directs the action of the CGR and the DHP as needed.

DFL is continuously collected with the DFLD and the processor compares the collected DFL with the DFLt. The system can also diagnose if vapor blow through is happening via checking other related production and pump performance data and comparison with the model index in FIG. 2. However, vapor blow through should not occur if the vapor blow through avoidance system is operating correctly.

The CGR rate and DHP rate are then adjusted as needed based on the following logic (see also FIG. 3):

a. Increase CGR rate, or reduce DHP rate as a second option, if gas column building up is detected to the pre-set criteria (DFL<DFLt).

b. Reduce CGR or increase DHP rate if DFL>DFLt.

c. Keep CGR and the DHP rates constant if DFL remains stable at the target level DFLt or within the target DFLt range.

Importantly, removing casing gas will result in pressure reduction in the casing, which may further promote gas break out or steam flashing. Thus, the rate of gas exit through the CGB or AC should be controlled so the pressure does not get too low. Of course, the CGR should have enough power and throughput to be able to remove adequate vapor for practical ranges of casing pressure.

The DFLt can be adjusted or changed any time between each logic cycle. Setting or changing the target DFLt is based on: pump submergible height request considering reservoir productivity and to allow the least frequent changes of the CGB and the highest possible pump rate. Typically, a suitable range of DFLs will be set as the target DFL, thus minimizing the on/off cycling of the systems.

Figure 6:
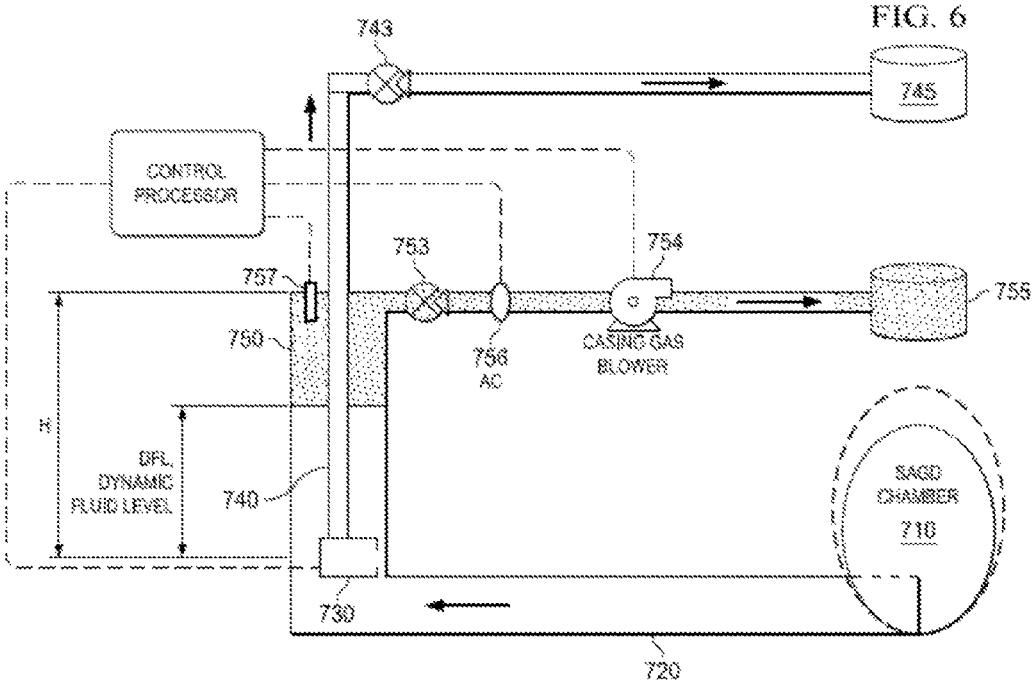
FIG. 6: Schematic of single well vapor blow through avoidance system with both AC and CGB.

The schematic of the entire system is shown by FIG. 4. In FIG. 4, the SAGD chamber is 410 and it is fluidly connected to the casing liner (slotted liner) 420. Fluid enters pump 430 and is pumped to the surface via tubing 440 where it passes valve 443 on its way to e.g., unit 445. Vapor floats and is trapped in the annular space between casing 450 and pump tubing 440, past valve 453 to e.g., gas treater 455. Casing gas remover 454 is operably coupled to the control processor (herein represented symbolically with dotted lines). The control processor is also operably connected to a DFL detector 457 and pump 430. The control processor controls DFL primarily by activating the CGR, and secondarily by controlling the pump 430. The CGR 454 can be an adjustable choke or a casing gas blower or both can be used. FIG. 6 shows a system using both.

Figure 5:
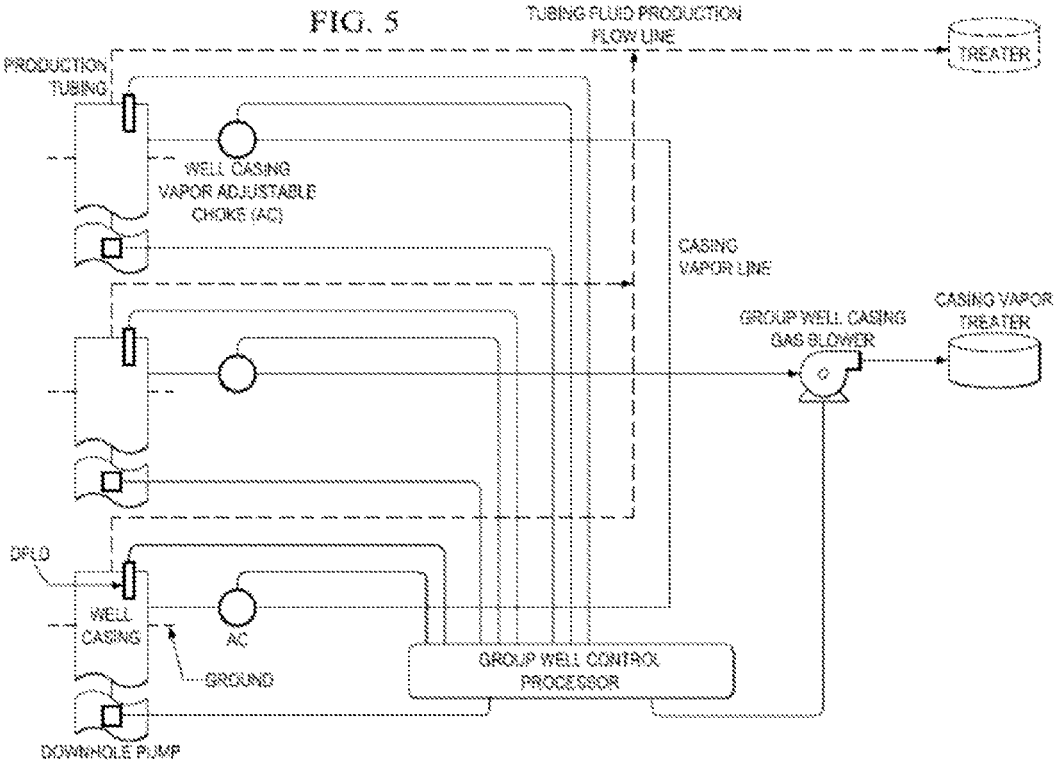
FIG. 5: Schematic of vapor blow through avoidance for a group of wells.

A group well application is illustrated in FIG. 5 (three shown, but could be any number). Three wells are shown, each with a DFLD, pump, and AC. Common CGB is shown and is connected to common casing gas line, downstream of the individual lines. The control processor can be single or multiple, as desired, but a single processor is shown and is more cost effective. The processor is operably connected (see dotted line) to the DFLDs, pumps, ACs and common CGB.

The DFLt is set individually for each specific well, and individual casing pressure is primarily controlled through the separate adjustable chokes (AC) installed on each gas casing. A larger CGB is installed and connected to the combined casing gas flow line for all three wells, and the CGB rate can be increased if the pressure is too high for the AC to function. The CGB should have sufficient horsepower and created sufficient pressure sink and rate for the combined wells. One advantage of this embodiment is cost savings, since multiple AC's are used instead of multiple CGBs. The ACs are passive, thus also saving energy costs over CGB use.

A schematic of an alternate embodiment is shown in FIG. 6. In FIG. 6, the SAGD chamber is 710 and it is fluidly connected to production tubing (slotted liner) 720. Fluid enters pump 730 and is pumped to the surface via tubing 740 where it passes valve 743 on its way to e.g., unit 745. Gas floats and is trapped in the annular space between outer casing 750 and pump tubing 740, past valve 753 to e.g., gas treater 755. CGB 754 and adjustable choke 756 are fluidly connected to the casing gas exit line and operably coupled to the control processor (herein represented symbolically with dotted lines). The control processor is also operably connected to a DFLD 757 and pump 730. The control processor controls DFL primarily by activating the AC, because this is a passive system not requiring energy. If needed, the CGB can be activated as a secondary control measure, and as a ternary option, the DHP speed can by changed by controlling the pump 730.

The process is applicable to any high gas content producing well, where gas disturbs pump performance. The producing well could be crude oil or gas well or any subsurface reservoir fluid producing well, including horizontal, vertical, deviated and cluster wells, for instance coal bed methane water removing well or SAGD bitumen producing well. Equipment and process control computer program can be further developed and manufactured based on this innovation.

The invention claimed is:

1. A method of preventing vapor blow through in a production well, said method comprising:

a. providing a vapor blow through avoidance system for an oil well, said system comprising:
   i. a casing gas remover (CGR);
   ii. a dynamic fluid level detector (DFLD) for detecting a dynamic fluid level (DFL);
   iii. a downhole pump (DHP);
   iv. a control processor operatively connected to said CGR, DFLD and DHP;

b. said DFLD determining said DFL;

c. said control processor comparing said DFL against a target DFL (DFLt) and:
   i. increasing a rate of said CGR or reducing a rate of said DHP if DFL<DFLt,
   ii. maintaining said rate of said CGR and said rate of said DHP if DFL=DFLt;
   iii. decreasing said rate of said CGR or increasing said rate of said DHP if DFL>DFLt.

2. The method of claim 1, said vapor blow through avoidance system further comprising temperature sensors, pressure sensors, flow sensors, and one or more pump operating parameter sensors.

3. The method of claim 1, wherein said CGR is a multiphase pump or compressor.

4. The method of claim 1, wherein said CGR is a casing gas blower (CGB) or adjustable choke (AC) or both.

5. The method of claim 1, wherein said CGR includes both an AC and a CGB and wherein primary control is via said AC and secondary control is via said CGB and ternary control is via said DHP.

6. The method of claim 1, wherein said determining step b is continuously determining said DFL.

7. The method of claim 1, wherein said determining step b is repeatedly determining said DFL.

8. The method of claim 1, wherein said DFLt is a range of acceptable dynamic fluid levels.

9. A method of preventing vapor blow through in a production well for producing oil from a reservoir, said method comprising:

a. determining a dynamic fluid level (DFL) with a dynamic fluid level detector (DFLD), b. comparing said determined DFL against a target DFL (DFLt), and:

i. increasing a rate of casing gas removal or reducing a rate of pumping fluid if DFL<DFLt;

ii. maintaining said rate of casing gas removal and said rate of pumping fluid if DFL=DFLt;

iii. decreasing said rate of casing gas removal or increasing said rate pumping fluid if DFL>DFLt.

10. The method of claim 9, wherein said DFLt is a range of dynamic fluid levels.

11. The method of claim 9, wherein said DFLt is a range of dynamic fluid levels at least one meter above zero, wherein zero is the level of intake of a downhole pump.

12. A vapor blow through avoidance system for an oil well, said system comprising:

a. a casing gas remover (CGR) fluidly connected to a casing gas exit tube fluidly connected to an annular spacing around a production well tubing, wherein said CGR is a casing gas blower (CGB) or an adjustable choke (AC) or both;

b. a downhole pump (DHP) inside said casing, connected to the said production tubing and having a pump intake at or near a well bottom;

c. a dynamic fluid level detector (DFLD) for measuring a dynamic fluid level (DFL), said DFL being a height of a liquid in said annular spacing from a top of said pump intake to a gas cap in said annular spacing; and d. a control processor operatively connected to said CGR, CGB, DFLD and DHP and capable of comparing said DFL to a target DFL and adjusting said CGR or DHP to keep said DFL at said target DFL.

13. The system of claim 12, wherein said target DFL is a range of acceptable dynamic fluid levels.

14. The system of claim 12, wherein the DFLD continuously determines said DFL and said control processor:

a. increases a rate of said CGR or reduces a rate of said DHP if DFL<DFLt;

b. maintains said rate of said CGR and said rate of said DHP if DFL=DFLt; or c. decreases said rate of said CGR or increases said rate of said DHP if DFL>DFLt.

15. The system of claim 12, applied to a group of wells.

16. The system of claim 12, applied to a group of wells, each well having an AC and said group of wells having a common CGB.

17. The system of claim 16, said each well having a target DFL and said control processor primarily controlling each well via controlling said AC, secondarily controlling said common CGB, and ternary control of said DHP.

18. A computer system for preventing vapor blow through in an oil production well, said computer system accepting data from an operably connected dynamic fluid level detector (DFLD) and controlling an operably connected downhole pump (DHP) and controlling an operably connected casing gas remover (CGR), said computer system increasing a rate of said CGR or reducing a rate of said DHP if the dynamic fluid level (DFL) is less than a target DFL, and decreasing said rate of said CGB or increases said rate of said DHP if DFL is greater than said target DFL.

* * * * *